United States Patent [19]

Aich

[11] Patent Number: 4,738,240

[45] Date of Patent: Apr. 19, 1988

[54] PROCESS FOR CUTTING A DIAMOND TO PROVIDE AN INVISIBLE MOUNTING

[75] Inventor: Rene M. Aich, Paris, France

[73] Assignees: Rene Liotaud, Boulogne; Henri Jean Azema, Paris, both of France

[21] Appl. No.: 922,843

[22] Filed: Oct. 23, 1986

[51] Int. Cl.[4] ..... B28D 5/00

[52] U.S. Cl. ..... 125/30 R; 63/26

[58] Field of Search ..... 63/26, 29; 125/30 R, 125/13 R

[56] References Cited

U.S. PATENT DOCUMENTS

| | | | |
|---|---|---|---|
| 732,119 | 6/1903 | Schenck | 125/30 R |
| 835,964 | 11/1906 | Loesser | 125/30 R |
| 2,141,363 | 12/1938 | Rigollet | 63/26 |
| 3,421,341 | 1/1969 | Hodge | 63/29 |
| 4,564,000 | 1/1986 | Stern | 125/13 R |

FOREIGN PATENT DOCUMENTS

| | | | |
|---|---|---|---|
| 764966 | 3/1934 | France | 63/26 |
| 802367 | 9/1936 | France . | |
| 196455 | 10/1986 | France | 63/26 |

*Primary Examiner*—Harold D. Whitehead

*Attorney, Agent, or Firm*—Young & Thompson

[57] ABSTRACT

A process for cutting a diamond to realize an invisible mounting by using cuts situated below the girdle in which may be engaged the mounting. According to the invention the notches (7) have the shape of a dihedron (4) of which the two surfaces (5–6) are situated on both sides of the plane of the natural table along which is oriented the polished table (1), the two surfaces (5–6) of each dihedron being themselves polished by using a sawing machine in which the diamond carrier is movably mounted along a direction parallel to the plane of the disk and driven in an alternating motion along this direction, the surface of the disk being coated with a mixture of bort and gum arabic diluted with water, the polishing speed of the surface of the disk with respect to the diamond being comprised between 2500 and 3200 m/min., with about 10 passages per minute of the diamond in contact with the surface of the disk.

6 Claims, 1 Drawing Sheet

PROCESS FOR CUTTING A DIAMOND TO PROVIDE AN INVISIBLE MOUNTING

BACKGROUND OF THE INVENTION

In FR-A-802,367, it is proposed to mount precious stones on a mounting by making notches or cuts in the stones, on each edge of the pavilion which constitutes its lower portion. It is stated that the disclosed cuts in the stones, in the form of grooves made by sawing, could be different.

Even if the teaching of this patent proves sufficient in the case of colored stones, it does not permit realizing a diamond mounting that is truly invisible. The cuts or notches, whatever may be their shape and their position on the edge, impart grey reflections to the polished table, which makes usage on diamonds of the mounting described in FR-A-802,327 absolutely impossible.

SUMMARY OF THE INVENTION

The present invention has as an object to overcome these disadvantages and it has as an object a process for cutting a diamond so as to allow providing the edges of its pavilion beneath the girdle with notches or cuts in which the mounting may be engaged, characterized in that the notches have the shape of a dihedron of which the two surfaces are situated on both sides of the plane of the natural table along which is oriented the polished table, the two surfaces of each dihedron being themselves polished.

The inventor has in fact verified that when the two surfaces of the dihedron are polished, the setting, as well as the metallic portion engaged in the notch and the notch itself, are totally invisible and do not alter the dispersion of the stone.

It is known that it is impossible to polish a diamond along the cubic crystallization planes, so-called four-point table parallel to the plane passing through the four coplanar summits of an octahedron, three-point table parallel to the plane passing through three coplanar summits of the octahedron and two-point table which passes through two summits, that is to say an edge, of the octahedron.

Consequently, when the stone is cut from a whole crystal or from a half crystal with the cut polished table following the four-point table, the polished table being inclined at least 7° with respect to the four-point table, the cuts are made on the two-point table and the surfaces of each dihedron forming a notch are, one, substantially parallel to the polished table and, the other, inclined at an angle of at least 30° with respect to the first.

When the polished table is disposed on the three-point table, the cuts are made on the four-point table.

When the polished table is rocked on the two-point table, the cuts are made on the two-point table.

The cuts are made with a sawing machine or by laser, then the surfaces of the dihedron, one of which is substantially parallel to the polished table and the other inclined at an angle of at least 30° with respect to the first, are polished by using a sawing machine, of which the carriage carrying the diamond has been rendered movable along a direction parallel to the plane of the sawing disk, the surface of the disk being coated with a mixture of bort and gum arabic diluted with water, the polishing speed of the disk surface with respect to the diamond being comprised between 2500 and 3200 m/min., preferably 2750 to 2900 m/min., with about 10 passages per minute of the diamond in contact with the surface of the disk and a passage speed of 2 m/min.

The nature of the abrasive, namely a mixture of bort and gum arabic is essential for avoiding the depolishing of the facets of the girdle and of the table during the polishing of the dihedral surfaces.

The relative speed of the surface of the polishing disk with respect to the diamond must be greater than a minimum speed of 2500 m/min., below which no polishing occurs, but remain less than a maximum speed of 3200 m/min., above which there is combustion of the diamond. Moreover, it is necessary that the durations of polishing be brief and separated by periods of cooling, which is why the carriage carrying the diamond should preferably make about five back-and-forth movements per minute with a passage speed of the diamond of about 2 m/min.

BRIEF DESCRIPTION OF THE DRAWINGS

The invention will be described in more detail hereinafter with reference to the accompanying drawing, in which.

DETAILED DESCRIPTION OF THE INVENTION

Figure 1:
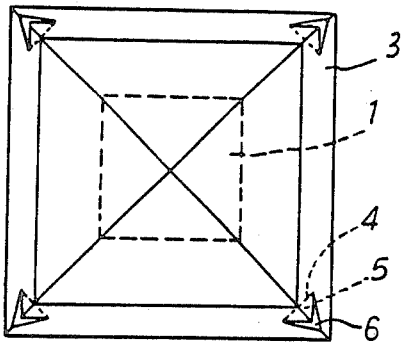
FIG. 1 is a view from below of a diamond provided with notches according to the invention.
Figure 2:
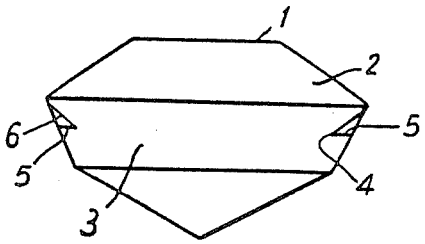
FIG. 2 is a view in elevation.
Figure 3:
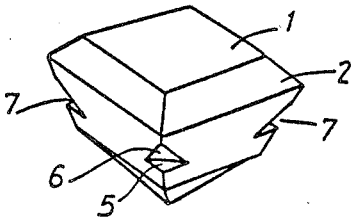
FIG. 3 is a perspective view.

In the drawings, reference numeral 1 designates the table of the cut diamond, reference 2 the facets of the girdle and reference 3 the pavilion.

According to the invention, notches 7 are effected in the edges of the pavilion. These notches are edge dihedrons 4 orthogonal to the edge of the pavilion with the two surfaces of the dihedrons being polished, one of the surfaces 5 being substantially parallel to the table 1 and the other 6 making an angle of about 30° with respect to the surface 5.

Figure 4:
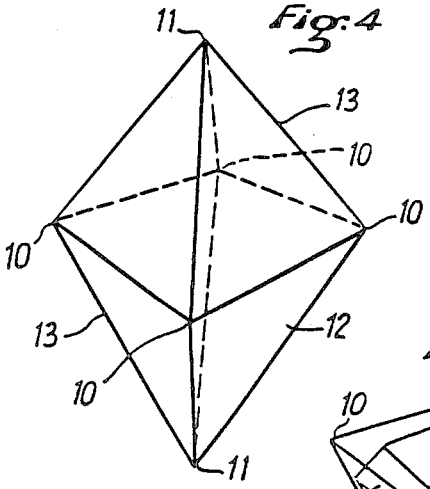
FIG. 4 is a view of the natural crystallization octahedron of a diamond intended to explain the orientation of the tables.

In the crystallization octahedron of the dihedron shown in FIG. 4, the plane passing through the four points 10 of the base of the pyramids and the planes parallel to this plane are called four-point tables. The surface 12 passing through two points 10 and a summit 11 of a pyramid is named a three-point table, and a surface passing through one edge 13 of the tetrahedron is called a two-point table. The natural tables may not practically be polished because of their hardness, the facets of the cut diamond and particularly the table 1 must make a minimum angle of about 7° with the natural table along which the facet is cut.

Figure 5:
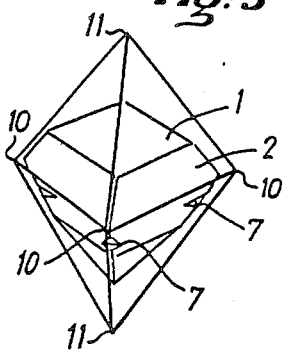
FIG. 5 is a view illustrating the position of the notches on a diamond cut from an entire gem.

In FIG. 5 the diamond is cut from an entire gem and the table 1 is inclined at an angle of at least 7° to the four-point table, the preliminary cuts for the notches 7 are effected in the two-point table and the facets of the dihedrons are then polished, the facets 5 being substantially parallel to the table 1, that is to say inclined about 7° to the four-point table. The facets 6 are inclined about 30°.

Figure 6:
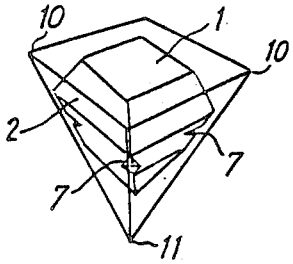
FIG. 6 is a corresponding view of a diamond cut from a half crystal.

In the case of a diamond cut from a half crystal, shown in FIG. 6, the rules for formation of the notches are the same as for an entire crystal.

Figure 7:
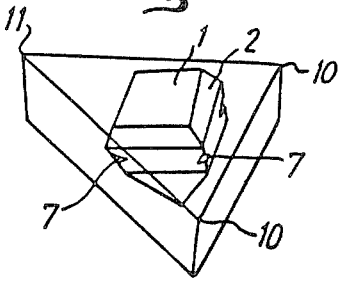
FIG. 7 is a corresponding view in the case of a rough cleaved diamond.

In the case illustrated in FIG. 7, of a so-called rough cleaved diamond, the table 1 is also inclined at least 7° to the three-point table 10–11. The exit cuts from the notches 7 are sawn on the four-point table and the surfaces polished according to the same rules by making an angle of at least 7° with the four-point table.

Figure 8:
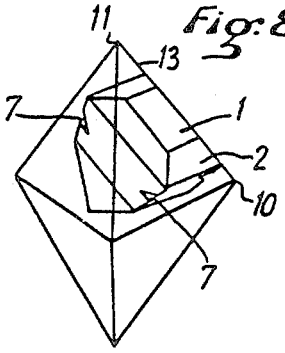
FIG. 8 is a corresponding view in the case of a diamond with a table at an angle to the four-point table.

In the case illustrated in FIG. 8, of a diamond with table tilted to the two-point table, the cuts of the notches are effected on the two-point tables and the polished facets 5 and 6 are parallel to the table 1 and inclined about 30° with respect to this latter, respectively.

The cuts of the notches are either sawn by successive passes of 4/1000ths of mm, or cut with a laser. The faces of the dihedron constituting the notch are then polished on a sawing machine of which the diamond carrier is mounted on a carriage driven in an alternating motion along a path parallel to the plane of the disk of the machine. This alternating motion has an amplitude of about 20 cm and a frequency of 12 seconds, which gives a speed of 2 m/minute and a passage frequency of the diamond in contact with the disk of 10 per minute.

The disk having a diameter of 15 cm is driven at a speed of 6000 rpm and its surface is coated with a mixture of bort and gum arabic diluted with water.

I claim:

1. A process for cutting a diamond to provide an invisible mounting by using cuts situated in the pavilion in which may be engaged the mounting, characterized in that the notches (7) have the shape of a dihedron (4) of which the two surfaces (5–6) are situated on opposite sides of the plane of the natural table of the diamond crystal along which is oriented the polished table (1) of the cut diamond, the two surfaces (5–6) of each dihedron being themselves polished.

2. Process according to claim 1, characterized in that the surfaces of each dihedron forming a notch are, one, substantially parallel to the polished table of the diamond and, the other, inclined at an angle of at least 30° with respect to the first.

3. Process according to claim 1 applied to a diamond cut from a whole or half crystal, with the polished table (1) of the diamond cut along the four-point table of the crystal, the polished table being inclined at least 7° with respect to the four-point table, characterized in that the cuts are made on the two-point table.

4. Process according to claim 1 applied to a rough cleaved crystal or placed on the three-point table of the crystal, characterized in that the cuts are made on the four-point table of the crystal.

5. Process according to claim 1, applied to a stone oriented on a two-point table of the crystal, characterized in that the cuts are made on a two-point table of the crystal.

6. A process according to claim 3, characterized in that the cuts are made by laser and their surfaces polished by polishing.

* * * * *